United States Patent [19]

Lapierre

[11] 4,266,366

[45] May 12, 1981

[54] PREFABRICATED AIRPLANE MODEL KIT

[76] Inventor: Philippe Lapierre, 4 rue Pauly, 75014 Paris, France

[21] Appl. No.: 2,202

[22] Filed: Jan. 9, 1979

[30] Foreign Application Priority Data

Jan. 13, 1978 [FR] France ..... 78 00972

[51] Int. Cl.[3] ..... A63H 27/00; A63H 27/02

[52] U.S. Cl. ..... 46/76 R; 46/16

[58] Field of Search ..... 46/76 R, 79, 76 A, 77, 46/78, 11, 16; 244/117 R

[56] References Cited

U.S. PATENT DOCUMENTS 2,058,265 10/1936 Selley ..... 46/16 UX 2,939,242 6/1960 Papadakis ..... 46/76 R X 3,640,491 2/1972 Harrison ..... 46/76 R X

*Primary Examiner*—Robert Peshock

*Assistant Examiner*—Mickey Yu

*Attorney, Agent, or Firm*—Lewis H. Eslinger

[57] ABSTRACT

An airplane model kit comprises one or more wings, integrally formed with temporary frames which are joined to the wings at their periphery, which frames are intended to avoid any deformation of the wings and are provided with imprints and lugs for easy and accurate positioning of the wing with respect to the fuselage or the rest of the model. The frames further comprise a planar surface for ensuring that the frame-wing assembly does not twist and for ensuring the accurate positioning of the different wings with respect to one another.

15 Claims, 11 Drawing Figures

PREFABRICATED AIRPLANE MODEL KIT

The present invention relates to airplane models presented as building kits, and in particular to airplane models intended for free flight.

A number of methods are known for building these airplane models; the oldest and best known one consists in assembling a wood structure constituted essentially of fine sticks of wood and in covering it with paper or with a thin film of plastic material. This is the most rigid and the lightest method, but it takes a long time and requires a certain skill, and therefore can often discourage the beginner.

A number of simplifications have been proposed, by adopting prefabricated structural elements made of pre-cut and pre-shaped sheets of balsa, or from a light material such as for example molded or shaped expanded polystyrene. Some models are thus offered as building kits ready for final assembly. Such prefabricated parts are easy to fit together and help the beginner to arrive quickly at the completed model.

However, despite the adoption in general of strong parts for the wings, which, in the end, results in giving them bad aerodynamic and aesthetic characteristics, as well as making them heavy, the said wings often reach the user in a twisted and out-of-shape state, thereby impairing seriously the aspect and flying qualities of the model.

One of the most frequent causes of deformations, at least for those parts made of expanded polystyrene which in effect are widely used, is related to the great malleability of this particular material between the time when it comes out of the mold and the time when it is perfectly dry.

Furthermore, taking for example an airplane with strut-braced wings, whose wings are joined to the fuselage only by centre section struts, this is, most of the time, assembled together "by guesswork" and without any precise reference, hence more building problems and an additional source of geometrical and aerodynamical defects.

It was proposed, in order to solve these difficulties, to assemble the elements of the model inside an assembly jig supplied therewith, and designed so as to allow an easy and accurate positioning of the different elements and so avoid any geometrical defect which could interfere with the flight. However, such a jig, which surrounds partly or totally the model, is expensive since it constitutes an important addition of worked material with respect to the model kit proper, and gives the marketed article a cost and dimensions which may be found prohibitive.

With the airplane model kits according to the invention, it is possible to overcome these various disadvantages and to supply the user with prefabricated, light and non-deformed wings, at the lowest possible cost, which wings can be easily and accurately fitted to the fuselages of the models, even in those cases where they have no points in common (such as in the case of strut-braced wings), and also to obtain without difficulty, models with a good geometry, true to the original, and with satisfactory aerodynamical characteristics for eventual flight.

The airplane model kits according to the invention are essentially characterized by the presence of a prefabricated wing made rigid by means of a frame to which it is joined in a number of points of its periphery, which frame is molded or shaped with the said wing, and is sufficiently rigid to oppose without any noticeable or permanent deformation of the wing, the normal strains related to the drying, storing and assembling operations, and which frame is further provided with means to ensure an accurate matching to the fuselage or to the rest of the model, whether or not with the help of intermediate elements, said frame being removed once the assembling is completed.

DETAILED DESCRIPTION OF THE PREFERRED EMBODIMENTS

Figure 1:
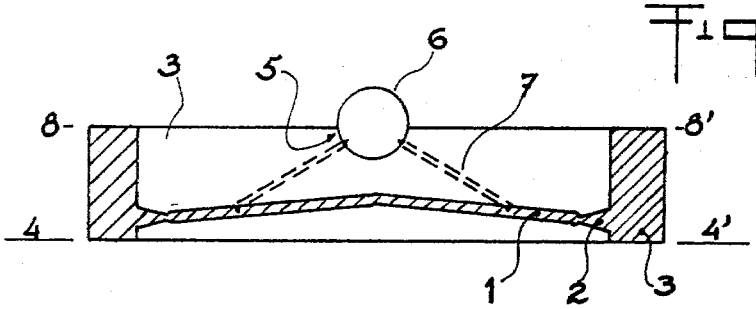
FIG. 1 is a schematic, partial cross-sectional view of one embodiment of an airplane model kit according to this invention.

The advantages and main characteristics of the invention will be better understood by referring to FIG. 1 which shows an airplane model kit mounted according to one embodiment of the invention, and shown in cross-section along the span of the airplane, during assembly.

A wing 1 is shown to be joined by tongues 2 to its frame 3, said latter resting by its face 4-4' on the working plane or table. The fuselage 6 is placed in imprints 5 made in the frame 3, and to which it is accurately adjusted, thereby ensuring a relative fuselage/frame/wing position which is easy and fixed.

The wing struts 7 ensuring the permanent joint between the fuselage and the wing may then be adhesively positioned without difficulty, this operation being yet made easier by the presence of lugs at the end of the struts, which lugs fit into recesses provided to this effect in the wing and in the fuselage. Once these joints are dry, and the remaining part of the assembling is completed, the tongues 2 are cut or broken off, and the frame thus freed is removed.

Preferably, the frame 3 has a plane reference surface 4-4', on the upper surface side of the wing, and substantially parallel to the general plane of the wings. It is possible with said reference surface to control the non-deformation of the wings plane (an aerodynamic characteristic which is essential to flight) by simply comparison with a plane control surface, and also to remove any defective parts. Said reference surface which is an easy guide to the position in space of the wings plane, is also used for correctly setting said planes in position with respect to one another, when there are more than one, by laying one over the other, or over the same working plane, as will be described hereinafter. The opposite surface 8-8' is preferably plane and parallel to 4-4' to allow stacking up for storing and drying purposes, particularly when parts made of expanded polystyrene are used.

The tongues 2, which are preferably distributed regularly around the wing so that said latter can get the best advantage from the rigidity of the frame, preferably comprise an area, close to the wing, whose cross-section is smaller than that of the said wing, to facilitate the cutting off of the tongues and to minimise the risks of damages to the wing during that operation and during the removal of the frame.

Figure 2:
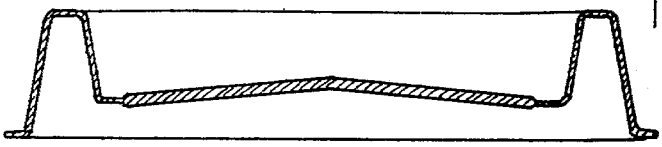
FIG. 2 is a cross-sectional view of one embodiment of a wing-frame assembly according to this invention.

The shape of the frame shown in FIG. 1 is not restrictive. It will be particularly dependent on the material used for its manufacture. FIG. 2 shows another example of embodiment according to the invention, by thermo-shaping the wing and its frame, from a sheet of expanded or non-expanded plastic material. In such a case, the wing must initially be joined to its frame over its whole periphery; it is possible for either a small or a large part of this periphery to be cut, sheared or punched to facilitate the final cutting work. In the same way, the wing and the frame, or the wing only may be produced by pasting two elements together, one element of the upper surface and one element of the under surface, so as to form a hollow, light and rigid body.

The imprints 5 made in the frame to receive the fuselage 6 are preferably provided with additional reliefs or housings with a view to preventing the fuselage from moving freely with respect to the frame, thereby eliminating all possibility of error when positioning the wing with respect to the fuselage.

Figure 3:
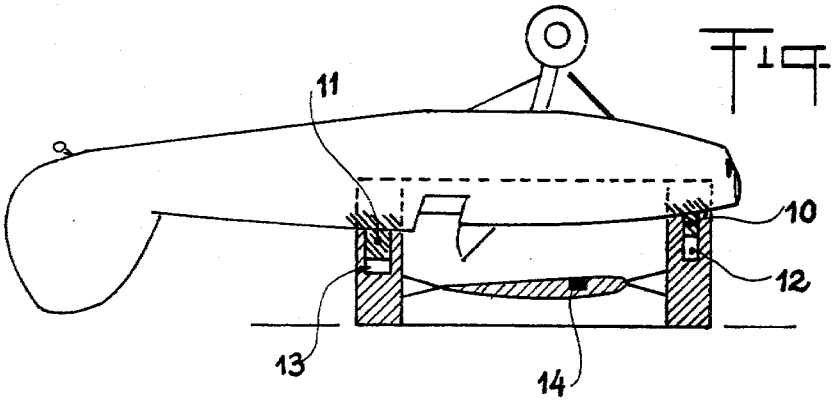
FIG. 3 is a partial cross-sectional view of another embodiment of an airplane model kit according to this invention, showing the alignment of the fuselage with the frame.

FIG. 3 shows by way of example a possible embodiment of such reliefs, constituted by lugs 10 and 11 which are integral with the fuselage, and fit by friction into the recesses 12 and 13 provided in the frame. As an extra precaution said lugs 10 and 11 can be of different size or shape to prevent a wrong assembling by an inexperienced user. The friction makes it possible to constitute, after fitting, a fuselage-frame-wing assembly which is consistent enough to be handled without any risk of relative movement. The final cutting operation of the frame-wing joining elements is thus made easier, since the frame stays, right to the end, rigidly joined to the fuselage, without any risk of the last tongues being torn off by either a clumsy movement or by its own weight. After the frame has been removed, the lugs 10 and 11 are erased so as to return to the fuselage its true outline.

Said FIG. 3 also shows the possibility of reinforcing the prefabricated structure, if necessary, by means of one or more added elements, such as a stick of balsa 14 glued in a groove provided to this effect in the wing when the latter is molded. Other reinforcement means which are already known may also be used: pasting in layers, or pasting on canvas, or varnishing, etc.

Figure 4:
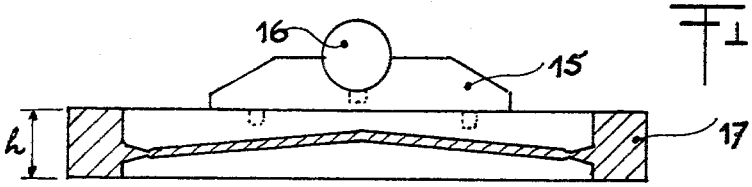
FIG. 4 is a schematic, partial cross-sectional view of another embodiment of an airplane model kit according to this invention.

FIG. 4 shows by way of example another embodiment of model elements according to the invention wherein an intermediate part 15 is used to secure the fuselage 16 to the frame 17, the joints 15-16 and 15-17 being preferably made by means of lugs and with friction as hereinabove explained. This solution may have the advantage of being less expensive insofar as it allows the height h of the frame to be reduced, whilst the said frame retains a parallelepipedic general shape of which the advantages have been described hereinabove. Said intermediate part may, in effect, be placed between the fuselage and the wing without for all that departing from the scope of the invention.

The various possibilities illustrated hereinabove relate to the more general case of a model with a wing having no part in common with the fuselage, to which it is joined by means of wing struts only, once the model is assembled together.

Figure 5:
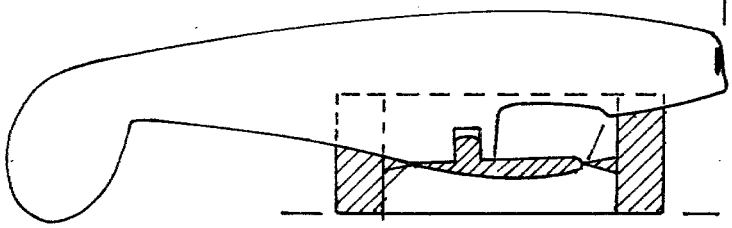
FIG. 5 is a partial cross-sectional view of another embodiment of an airplane model kit according to this invention, showing the fuselage being assembled directly on the wings.

A fortiori, the invention is applied to models with a wing joined to the fuselage. FIG. 5 gives an example of such a possibility, concerning a high-winged model, equipped with a widely glazed cabin between the fuselage and the wing. The positioning and holding lug is preferably placed in the wing and fits into a recess of the fuselage where it may be glued when matched therewith, thereby reinforcing the joint.

Figure 6:
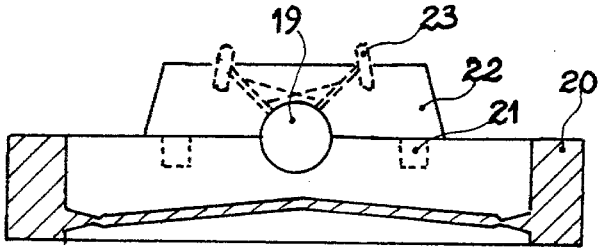
FIG. 6 is a schematic, partial cross-sectional view of another embodiment of an airplane model kit according to this invention, showing the fuselage being assembled on the frame indirectly by means of an auxiliary positioning element.

FIG. 6 gives another example of embodiment of the invention wherein an auxiliary part 22 is introduced to hold the fuselage 19 in the frame 20 by surrounding it, and is secured to the frame for example by means of friction lugs 21. Such a part is also used here as assembly jig for the undercarriage 23, an imprint of the undercarriage wheels and/or legs being provided in the said part.

Figure 7:
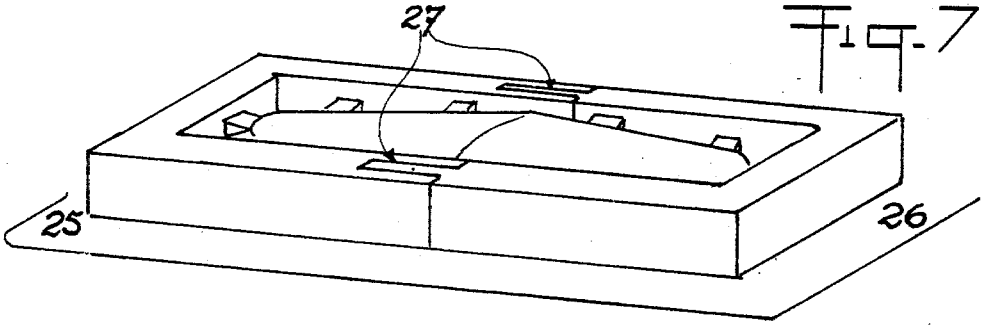
FIG. 7 is a perspective view of one embodiment of a frame-wing assembly according to this invention.

In the case of large size airplane models, it may be interesting, for reasons of overall dimensions of the airplane model kit, to produce the wings in two parts, left and right, provided that these can be accurately and easily assembled together before being assembled to the rest of the airplane, as hereinabove described. A possible embodiment of such wings in two parts is shown in FIG. 7 wherein the two frames of the half-wings are designed so as to be packed one above the other, thereby reducing the dimensions.

The two half-wings and frames are easily and accurately assembled by placing the two half-frames on the same plane working surface 25-26 used as a reference during the joining and glueing together of the two parts. The notches 27 are preferably provided with joining surfaces which are perpendicular to the axis of the fuselage, so as to leave a possibility for the reference faces of the half-wings to completely adopt the shape of the plane 25-26.

Figure 8:
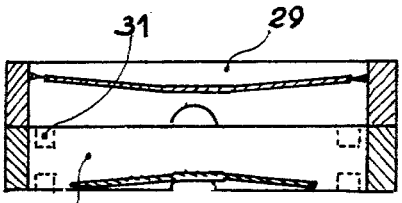
FIG. 8 is a schematic, partial cross-sectional view of a biplane airplane model kit according to this invention in its stored configuration.
Figure 9:
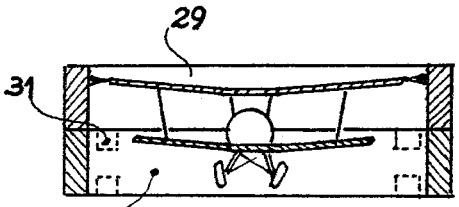
FIG. 9 is a schematic, partial cross-sectional view of the airplane model kit of FIG. 8 in its assembled configuration.

It is similarly advantageous in bi-plane models to confer to the frame of the two wings a shape and a size such that they can:

in a first relative position illustrated in FIG. 8, provide an inner volume, limited to the wings and to the frame, large enough to contain the other elements of the model and so serve as a container for the packing and commercialization;

in the relative assembly position of the model, shown in FIG. 9, be adjusted face over face in order to ensure a perfect relative position of the two wings. The same lugs may be used for both cases.

Figure 10:
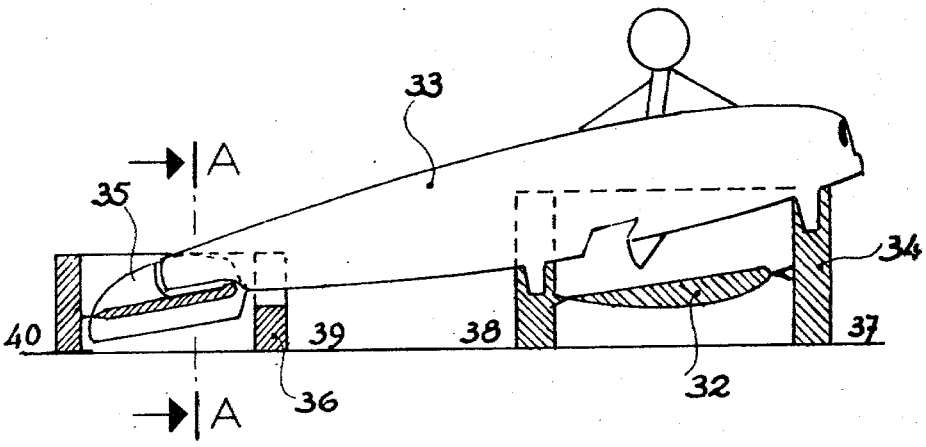
FIG. 10 is a partial cross-sectional view of another embodiment of an airplane model kit according to this invention, showing a frame for the assembly of the stabilizers.
Figure 11:
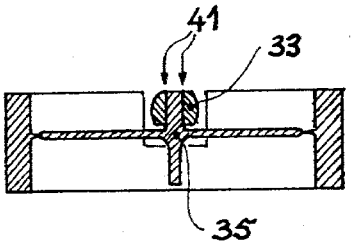
FIG. 11 is a cross-sectional view of the airplane model kit of FIG. 10 taken along lines A—A.

For very large-sized models, the risks of the fuselages and the stabilizers being deformed is not to be neglected, and it may be preferable when producing the stabilizer to enclose it in a frame such as the main wing. Possible deformations of the fuselage may similarly be overcome by using the stabilizer-mounting method shown in FIG. 10: the main wing is matched to the fuselage by its frame, as already described; the stabilizer is in turn positioned with respect to the wing, using the plane working table as a reference, and ensuring that the surfaces 37-38 and 39-40 are in alignment. To take full advantage of this reference, the matching surfaces where the fuselage is joined to the stabilizer, referred to in 41 in the cross-section A of the FIG. 10, are in a plane which is parallel to the keel of the model. This way, the relief angle of the stabilizer with respect to the wing is perfectly respected, even though the fuselage may be bent.

The present invention is applicable to all airplane models presented as constructional kits and having prefabricated wing elements.

A particularly interesting application is constituted by flying airplane models, whether biplane or with strut-braced wings, and either rubber powered, or gas powered or electric powered, of which the main elements are prefabricated and made from molded expanded polystyrene, possibly reinforced by more rigid elements, made of balsa for example.

What is claimed is:

1. An airplane model kit for forming an airplane model comprising:

a fuselage;

a frame-wing assembly including at least one wing and a temporary frame with which at least a portion of said at least one wing is prefabricated in an integral manner; and means for ensuring an accurate matching of said frame-wing assembly with respect to the fuselage.

2. An airplane model kit as claimed in claim 1, wherein said temporary frame defines an inner space which is adapted to contain said at least one wing formed integral therewith and a portion of the remainder of the model to thereby constitute at least part of a packing container for the kit.

3. An airplane model kit as claimed in claim 1, wherein said temporary frame includes at least two frame portions and the at least one wing is constituted by at least two separate wing parts each at least partly integral with a respective one of said frame portions, said frame portions being adapted to be positioned relative to each other so as to form a casing which serves as a packing container for the at least one wing.

4. An airplane model kit as claimed in claim 3, wherein each of said frame portions includes a planar surface substantially parallel to the plane of a respective wing part with which it is formed and the at least two wing parts include a left part and a right part formed at least partially with two frame portions, respectively, in an integral manner, wherein said wing parts are designed to be joined together by maintaining the planar surfaces of said two frame portions on a planar working surface.

5. An airplane model kit as claimed in claim 1, wherein the frame includes at least one planar surface substantially parallel to the general plane of the at least one wing.

6. An airplane model kit as claimed in claim 4, further comprising a stabilizer and a stabilizer frame surrounding said stabilizer, said stabilizer frame having a reference surface which is aligned with a planar surface of the temporary frame in order to obtain correct positioning of the stabilizer with respect to the fuselage.

7. An airplane model kit as claimed in claim 1, wherein said frame includes two frame portions each having a planar face and the at least one wing includes two biplane wings mounted in said two frame portions, respectively, and which are adapted to be positioned relative to each other by matching the frame portions so that the planar faces thereof are in contact.

8. An airplane model kit as claimed in claim 1, wherein said means for ensuring an accurate matching includes at least one recess formed in said frame and in which said fuselage is adapted to be disposed for directly matching said fuselage with respect to said frame-wing assembly.

9. An airplane model kit as claimed in claim 1, further comprising auxiliary reinforcement elements added to the frame-wing assembly.

10. An airplane model kit as claimed in claim 1, wherein at least one of said at least one wing and said frame are comprised of two elements constituting a hollow structure when assembled.

11. An airplane model kit as claimed in claim 1, wherein said means for ensuring an accurate matching includes at least one recess formed in one of said fuselage and frame-wing assembly and at least one positioning element integrally formed with the other of said fuselage and frame-wing assembly, said at least one positioning element being adapted to mate with said at least one recess for directly matching said fuselage with respect to said frame-wing assembly.

12. An airplane model kit as claimed in claim 11, wherein said at least one recess is formed in said frame and said at least one positioning element is integrally formed with said fuselage.

13. An airplane model kit as claimed in claim 11, wherein said at least one recess is formed in said fuselage and said at least one positioning element is integrally formed with said at least one wing.

14. An airplane model kit as claimed in claim 1, wherein said means for ensuring an accurate matching includes an auxiliary positioning element for indirectly matching said fuselage with respect to said frame-wing assembly.

15. An airplane model kit as claimed in claim 14, further comprising an undercarriage, wherein said auxiliary positioning element facilitates the assembly of the undercarriage of the model.

* * * * *